United States Patent [19]

Dix et al.

[11] 4,124,451

[45] Nov. 7, 1978

[54] CLOSURE FOR A COKING CHAMBER OF A COKING OVEN

[75] Inventors: Kurt Dix; Werner Hoffmann, both of Bochum, Fed. Rep. of Germany

[73] Assignee: G. Wolff Jr. Kommanditgesellschaft, Bochum-Linden, Fed. Rep. of Germany

[21] Appl. No.: 706,839

[22] Filed: Jul. 19, 1976

[30] Foreign Application Priority Data

Jul. 18, 1975 [DE] Fed. Rep. of Germany ..... 2532097

[51] Int. Cl.[2] ..... C10B 25/06

[52] U.S. Cl. ..... 202/248; 110/173 R; 202/269

[58] Field of Search ..... 202/242, 248, 263, 269; 110/173 R, 173 C, 175 R, 179; 122/498

[56] References Cited

U.S. PATENT DOCUMENTS

| | | | |
|---|---|---|---|
| 3,709,794 | 1/1973 | Kinzler et al. | 202/248 |
| 3,876,506 | 4/1975 | Dix et al. | 202/248 |
| 3,957,591 | 5/1976 | Riecker | 202/269 X |

FOREIGN PATENT DOCUMENTS

| | | | |
|---|---|---|---|
| 43,120 | 2/1910 | Austria | 110/173 C |

*Primary Examiner*—Morris O. Wolk
*Assistant Examiner*—Arnold Turk
*Attorney, Agent, or Firm*—Michael J. Striker

[57] ABSTRACT

The opening for charging a coking chamber of a coking oven is closed by closure means and a lock chamber is arranged outside the closure means for preventing any emissions from the coking chamber seeping past the closure means to pass to the outer atmosphere.

14 Claims, 16 Drawing Figures

Fig. 1

CLOSURE FOR A COKING CHAMBER OF A COKING OVEN

BACKGROUND OF THE INVENTION

The present invention relates to a closure for a coking chamber of a coking oven in which a door body can be pressed and held in tight engagement with a frame surrounding the charging opening of a coking chamber with sealing means sandwiched between the frame and the door body.

During operation of a plurality of coking ovens of a coking oven installation, the problem arises that during such operation dust, gases and tar-containing vapors penetrate into the surrounding atmosphere. In various countries laws have already been established for limiting such emissions from coking ovens to protect the environment.

One source of such emissions during operation of coking ovens is constituted by the closure means for closing the openings of the coking chambers through which the coking chambers are charged with the material to be coked. Despite considerable efforts it was so far not possible to provide a perfect and lasting seal in the region between the door frame and the door body during the coking operation.

A special difficulty in providing a proper seal of the coke oven chamber in the region of the coke oven chamber closure is due to the fact that the coke oven closure is located directly at the coking chamber head, that is, in a region at which very high temperatures and especially great temperature differences will occur. This will result into bending of the closure parts, which in turn will result in leakages in the region of the closure means and passing of emissions from the coking chamber to the outer atmosphere. Especially the longitudinal sides of the door frame, but also the door body including the sealing means coordinated therewith, will become distorted due to the heating thereof.

It has already been tried to prevent bending of the closure parts, due to the heating thereof, or at least to reduce such bending to a considerable degree, by providing in the door frame an annular cooling channel and passing a cooling liquid therethrough. Such constructions are however rather expensive and the temperature stresses have not been sufficiently reduced by such an arrangement.

In order to obtain a better seal at the door body, a construction has also been developed which includes an endless sealing bar from metal, mounted on the door body, held by friction thereon, but adjustable toward the door frame to engage the latter with a sealing edge. If in such a closure leakage occurs in the region between the door frame and the door body, due to the bending of these parts during heating, the endless sealing bar is moved, for instance by hammer blows, in tight engagement with the door frame. However, even during use of such as sealing bar, which produces a metal against metal seal, the closure of the coke oven chamber with respect to the surrounding atmosphere is not fully satisfying. This is due to incrustations forming on the door frame and the door body and especially on such surface portions of the door frame against which the sealing bar is pressed. Such incrustations are formed by graphite and condensates emanating from the coking chamber and such incrustations can prevent that the sealing bar abuts along its whole circumference directly onto the door frame.

In order to obtain from coking chamber closures with a sealing bar a substantially satisfying seal, it is necessary to remove such incrustations from the door frame, the door body and the sealing bar after each, or a plurality of coking operations. Such cleaning of the closure parts is, however, connected with a considerable expenditure of time. If such cleaning is not carried out by hand, but with mechanical cleaning devices, then an additional large expenditure for providing and maintaining such cleaning devices is necessary. Mechanical cleaning devices are, however, necessary for the cleaning of the closure parts in coke ovens of great height and high operating temperature, in which incrustations of the closure parts occur in large amount, so that considerable expenditures for maintaining and cleaning of the closure parts are necessary.

In closure means with sealing bars on the door body it has also been tried to improve the seal by stuffing glass wool or asbestos into such portions of the closure means at which leakage will occur during the coking operation. This additional sealing operation is likewise expensive and in addition it endangers the health of the operating personnel, since such additional sealing operations have to be carried out during the operation of the coking oven, so that the operating personnel is subjected to the high temperature in the region of the coking oven closure as well as to any emissions seeping past the closure means. Therefore, it has already been tried to improve the seal by constructing a double sealing bar with an asbestos packing therebetween, but even in this way a perfect seal has not been obtained.

Finally it has also been tried to improve the seal by providing in the region between door frame and door body a sealing space into which steam under pressure has been introduced, but a perfect, lasting seal of the coking chamber has also not been obtained with this construction. In addition, such a construction is rather expensive, especially due to the necessary equipment for producing the steam.

A further source of emission is created when the door body is formed with a planing aperture for planing or levelling the material fed in the coking chamber through the opening formed therein. This aperture has to be closed by additional closure means and in the region between the aperture and the additional closure means dust, gas and tar-containing vapors may also penetrate in the surrounding atmosphere. These additional emissions have so far also not been prevented.

SUMMARY OF THE INVENTION

It is an object of the present invention to provide a closure of the above-mentioned kind which seals the opening of the coking chamber in a perfect manner toward the outer atmosphere.

It is a further object of the present invention to provide a closure of the aforementioned kind which is constructed of relatively few and simple parts so that it can be manufactured at reasonable cost and be maintained in perfect order, while requiring only little maintenance.

With these and other objects in view, which will become apparent as the description proceeds, the closure means for closing a charging opening in a coking chamber of a coking oven mainly comprise an endless frame surrounding the opening and sealingly connected to the wall defining the coking chamber about the charging opening therein, first closure means engaging the frame for closing the aforementioned opening, and second closure means surrounding the frame and the first closure means and forming a lock chamber outwardly of the first closure means for receiving any emissions seeping past the first closure means and preventing passage of such emissions to the outer atmosphere. The lock chamber containing air will also receive any emissions seeping past the first closure means.

In such a construction the seal of the coking chamber toward the outer atmosphere is not only provided, as in the known coking chamber closure, in the region between the door frame and the door body, which is subjected to considerable fouling, but also by the lock chamber located forwardly of this region and closing this region gas-tightly towards the outer atmosphere. The provision of the lock chamber will positively prevent any emission of dust, gas and tar-containing vapors in the surrounding atmosphere. A proper seal of the lock chamber and therewith of the coking chamber towards the outer atmosphere is obtainable because the sealing surfaces of the lock chamber are at some distance from such closure parts which border directly onto the coking chamber and the lock chamber sealing surfaces are therefore not subjected to the high temperatures and the high temperature variations occurring during operation of the coking oven. Bending of the sealing surfaces of the lock chamber is therefore practically excluded and any occurring bending in the region of the sealing surfaces may be easily compensated by suitable sealing material which is not subjected to extreme high temperature or temperature variations. When the sealing faces of the lock chamber are arranged at a certain distance from the region between the door frame and the door body, any emissions penetrating into the lock chamber will lead only to a very small fouling of these sealing surfaces.

The lock chamber arranged ahead of the first closure means will also prevent that dust, gas and tar-containing vapors will penetrate between the door frame and the door body into the lock chamber, since the air contained in the lock chamber will be heated up during operation of the coking oven to a considerable degree to thereby increase the pressure in the lock chamber. In this way, the pressure maintained within the lock chamber will be, shortly after start of the coking operation, higher than the pressure within the coking chamber, since the latter pressure will, during the coking operation, quickly decrease. If the gas pressure in the locking chamber is higher than that within the coking chamber, any emission from the coking chamber into the lock chamber is practically excluded. In this case the lock chamber acts as an overpressure chamber.

On the other hand, the lock chamber can also be constructed as a suction chamber. In this case suction means communicate with the lock chamber, through which air and any emissions penetrating in the lock chamber may be sucked out from the latter. By thus maintaining a small gas pressure in the lock chamber, it is possible to construct the walls defining the lock chamber relatively light.

In order to provide in the region between the door frame and the door body a satisfying seal, it is advantageous to provide on the door body a sealing bar from metal which is adjustable toward the door frame. This, preferably endless, sealing bar surrounding the door body and held by friction on the latter can be sealingly pressed against the door frame. In order to properly seal the lock chamber towards the atmosphere an endless seal strip of elastically compressible material is provided on the cover of the lock chamber.

Elongated bracing members are preferably provided adjacent the longitudinal side of the door frame for supporting the coke oven walls and such bracing member are usually formed by I-beams. In one embodiment according to the present invention these I-beams are used to form part of the walls of the lock chamber and the lock chamber in this embodiment is formed by a pair of transverse walls extending between the bracing members adjacent the opening and fluid-tightly connected to the bracing members and the wall means forming the coking chamber, by portions of the bracing member between the transverse walls, a front plate extending between outer edges of the portions of the bracing members and the transverse walls, and sealing means sandwiched between the outer edges and the front plate.

In such a construction it is advisable to arrange the means for pressing the door body against the frame and for locking the door body in a position tightly engaging the frame, as well as an aperture provided in the door body and the additional closure means for this aperture, within the lock chamber. In this case, the means for pressing the door body against the frame and for locking the door body in a position tightly engaging the frame need not extend through the walls of the lock chamber which would require additional sealing means. Furthermore, since the aperture provided in the door body and the additional closure means therefor are likewise located in the lock chamber, any gas, dust or tar-containing vapors escaping past the additional closure means for the aperture into the lock chamber are prevented to seep into the surrounding atmosphere.

In this embodiment according to the present invention it is further advantageous to construct the front of the lock chamber as an outer door separated from the door body and covering the whole region between the bracing members and the transverse walls. This construction has the advantage that closure means according to the present invention can be subsequently provided on an already existing coking oven without large expenditures. In this case it is only necessary to provide, between the bracing members adjacent the opening, transverse walls at the upper and lower end of the opening and to abut the outer door against the bracing member and the transverse walls. If the bracing members are formed by I-beams, the outer door is preferably connected to the flanges of the I-beams which face away from the wall of the coking oven.

The outer door can for instance be held, in a gas-tight manner, by magnets or by a wedge arrangement against the outer edges of the transverse walls and the bracing members. In using magnets it is advisable to provide for the latter a cardanic suspension on the outer door. If a wedge arrangement is used, it is advisable to provide outer and inner wedges, whereby the outer wedges are to be connected to the bracing members and the inner wedges to the outer door. In this case it is advantageous to connect the outer wedges at one side of the outer door by a linkage movable in longitudinal direction of the bracing members. The use of magnets is preferred when the lock chamber is constructed as a suction chamber. However, if an overpressure is maintained in the lock chamber, the magnetic forces provided by the magnets would not be sufficient and in such a construction the mentioned wedge arrangement is preferred.

In this construction it is also advantageous to arrange between the door body and the outer door a radiation shield, extending substantially over the whole region of the outer door, spaced therefrom and parallel thereto. The radiation shield, which is preferably formed from aluminum, serves to shield the outer door against heat radiation passing through the door frame and the door body.

If the lock chamber is constituted by a pair of transverse walls extending between the bracing members adjacent the opening, the portions of the bracing members between the transverse walls, and a front plate, whereby the front plate is constituted by an outer door separated from the door body, the gas-tight closure of the opening in the wall of the coking chamber requires two operations, that is the door body is first pressed onto the door frame and then the outer door is pressed and held against the outer edges of the transverse walls and the portions of the bracing members.

On the other hand, by forming the lock chamber by transverse walls extending between the bracing members adjacent the opening, by portions of the bracing members between the transverse walls, and the aforementioned front plate extending between outer edges of the portions of the bracing members and the transverse walls, the door body may be box-shaped and have a bottom wall, for closing the opening of the coking chamber, and side walls projecting from the bottom wall into engagement with the front plate. If the side walls of the door body are in this case gas-tightly connected with the front plate, it is possible to operate the front plate and the door body together so that the closure of the opening of the coking chamber can be carried out in a single operating step. The front plate can be connected by screws or the like with the side walls of the door body and sealing means sandwiched therebetween.

In such a construction, an easy operation of the means for pressing the door body against the frame and for locking the door body in a position tightly engaging the frame can be obtained by providing an operating shaft for the pressing and locking means, which extend gastightly sealed through an opening in the front plate.

In this construction the front plate covers at least the area between the bracing members and the transverse walls, on the one hand, and between the side walls of the door body, on the other hand. If the front plate extends not over the whole surface of the bottom wall of the door body, the heat energy transmitted from the coking chamber to the door body can be easily transmitted to the outer atmosphere.

The pressing and locking means for the door body preferably comprise at least one locking bar turnably mounted on the door body and movable toward and away from the latter, holding means mounted on the frame adjacent the door body for holding the locking bar in a turned position thereof at a predetermined distance from the door body, and pressure producing means including resilient means between the locking bar and the door body, wherein the locking bar extends in the turned position through an opening in one of the side walls of the door body. In this construction the opening in the side wall of the door body is gastightly closed toward the outer atmosphere.

If in the above-mentioned embodiment substantial heat distortions at the sealing faces of the lock chamber can be expected, the arrangement preferably includes also a grooved bar, mounted on the front plate, adjustable toward the transverse plates and the portion of the bracing members, means for frictionally holding said grooved bar in any adjusted position, and sealing means of resiliently compressible material located in the groove of the grooved bar.

In another embodiment according to the present invention, the door body is box-shaped and comprises a bottom wall for closing the opening in the coking chamber and sidewalls projecting outwardly from the bottom wall. In this modification the lock chamber is constructed to form a channel about the door body, with the side walls of the door body forming part of the lock chamber. This modification has likewise the advantage that a complete sealing of the opening of the coking chamber can be carried out in a single operating step.

If the lock chamber is, in the manner as mentioned above, constituted by a lock channel surrounding the door body, then three different modifications are possible, which require only small additional expenditures, as compared with the known means for closing the opening provided in a coking chamber.

In one of these modifications the lock chamber is again constituted by a pair of transverse walls extending between the bracing members adjacent the opening, by portions of the bracing members between the transverse walls, and the front plate fluid-tightly covering, on the one hand, the region between said portions of the bracing members and the transverse walls, and, on the other hand, the region between the side walls projecting outwardly from the bottom wall of the door body. In this construction, the projecting side walls of the door body are preferably provided with an endless flange, projecting transverse to and outwardly from the outer ends of the side walls of the door body, and the front plate is connected to the transverse walls and the bracing members and abuts against said flange, with a seal sandwiched between the flange and the front plate. In this construction it is advantageous that the means for pressing the door body against the frame and for locking the door body in a position tightly engaging the frame comprise at least one locking bar turnably mounted on the door body and movable towards and away from the latter, holding means mounted on the frame for holding the locking bar in a turned position thereof at a predetermined distance from the door body, and resilient means between the locking bar and the door body, in which the locking bar is located outside the lock chamber and the holding means extend in a sealed manner through an opening in the front plate.

In all above-described modifications, it is possible to connect the transverse walls of the lock chamber directly to the bracing members and to the wall of the coking oven. However, considering the heating up of the transverse walls during the coking operation and the resulting change of the volume thereof, it is advantageous to provide opposite holding bars on the walls of the coking oven and the bracing members in which the opposite bars are formed with grooves having open sides facing each other and the opposite end portions of the transverse walls are respectively located with clearance in these grooves, with sealing means in the grooves between the end portions of the transverse walls and the holding bars so that the transverse walls are floatingly mounted in the holding bars.

If in the above-mentioned modifications transmission of heat to the surrounding atmosphere should be improved, the front plate may be provided at its outer surface with cooling ribs. If, on the other hand, the heat energy transmitted to the lock chamber should not be too quickly transmitted to the surrounding atmosphere, in order to maintain a sufficiently large overpressure within the lock chamber, then it is advantageous to provide a layer of heat insulating material on the inner surfaces of the bracing members.

If the lock chamber is in form of a lock channel surrounding the door body, it is not necessary that the bracing members or a part thereof are used as part of the walls of the lock chamber. According to a further modification of the present invention, the frame is provided with an endless wall, projecting adjacent the periphery of the door body outwardly from the remainder of the frame, and the lock chamber is in part defined by this projecting wall of the frame and side walls of the door body. In this construction it is advantageous that the side walls of the door body are provided with an endless flange projecting transverse to and outwardly from outer ends of the side walls and abutting against outer ends of the endless projecting wall of the frame, with a seal sandwiched between the endless flange and the endless projecting side wall of the frame. If in this construction the pressing and locking means for the door body comprise at least one turnable locking bar which is resiliently pressable against a locking bar holder, it is preferred that the locking bar holder is mounted on the endless wall of the frame and on the side thereof outside the lock chamber, with the locking bar located likewise outside of the lock chamber.

If the door frame is mounted on plate means applied to the outer surface of the wall means of the coking oven with sealing means sandwiched between the plate means and the frame, the lock chamber may also be formed as a channel between the side walls of the door body and an endless sealing frame surrounding the side walls spaced therefrom and sealingly connected to the plate means. In this construction it is again advantageous that the side walls of the door body are provided with an endless flange projecting transverse to and outwardly from outer ends of the side walls and abutting against the sealing frame, with a seal sandwiched between this endless flange and the sealing frame. In this construction the pressing and locking means for the door body may again comprise at least one locking bar which in its turned position may be resiliently pressed against a locking bar holder, and in this construction it is advantageous to connect the locking bar holder to the door frame, projecting in a gas-tight manner through an opening in the sealing frame, with the locking bar located outside of the lock chamber.

The described embodiments in which the lock chamber is formed as a lock channel have in common that the walls of the box-shaped door body are provided at the outer ends thereof with an endless flange, through which the door body can be pressed against the other wall portions of the lock chamber. In this way the closure of the opening in the coking chamber can be handled in an especially simple manner. This results from the fact that the locking bar is in this modification arranged outside of the lock chamber.

If the lock chamber is constructed as an overpressure chamber, it is advantageous to provide in the outer wall of the lock chamber at least one overpressure valve, to avoid excessive gas pressures in the lock chamber. Such overpressure valve will release gas from the lock chamber into the surrounding atmosphere, when a predetermined maximum gas pressure in the lock chamber is exceeded.

In such an arrangement, any emission of gas in the surrounding atmosphere can, however, be avoided if one lock chamber is connected with the lock chamber of an adjacent lock chamber through two overpresssure valves which act in opposite directions. In this case the decrease of an overpressure in on lock chamber occurs as a pressure equilization between two adjacent lock chambers. This way of reducing the overpressure in one lock chamber is facilitated in that adjacent lock chambers have, as a rule, at any time, different gas pressures. In the aforementioned construction it is advisable to mount the two overpressure valves in the web of a bracing member forming a common wall between adjacent lock chambers.

If the door body is formed with an aperture therethrough for levelling the material in the coking chamber, and in which this aperture is closed by additional closure means, it is advantageous to provide also an additional lock chamber outwardly of the additional closure means for preventing any emissions seeping past the additional closure means to pass to the outer atmosphere. This will assure that the coking chamber is also in the region of the planing or levelling aperture properly sealed toward the atmosphere.

Preferably, the additional closure means is also provided with a metal sealing bar adjustable towards the door body to sealingly engage the latter about the aperture.

The means forming the additional lock chamber preferably comprise an additional front plate closing the additional lock chamber and sealing means sandwiched between the additional and the first-mentioned front plate. Advantageously the additional closure means and the additional front plate are connected to each other so that these two elements may be pressed together against the aperture in the door body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
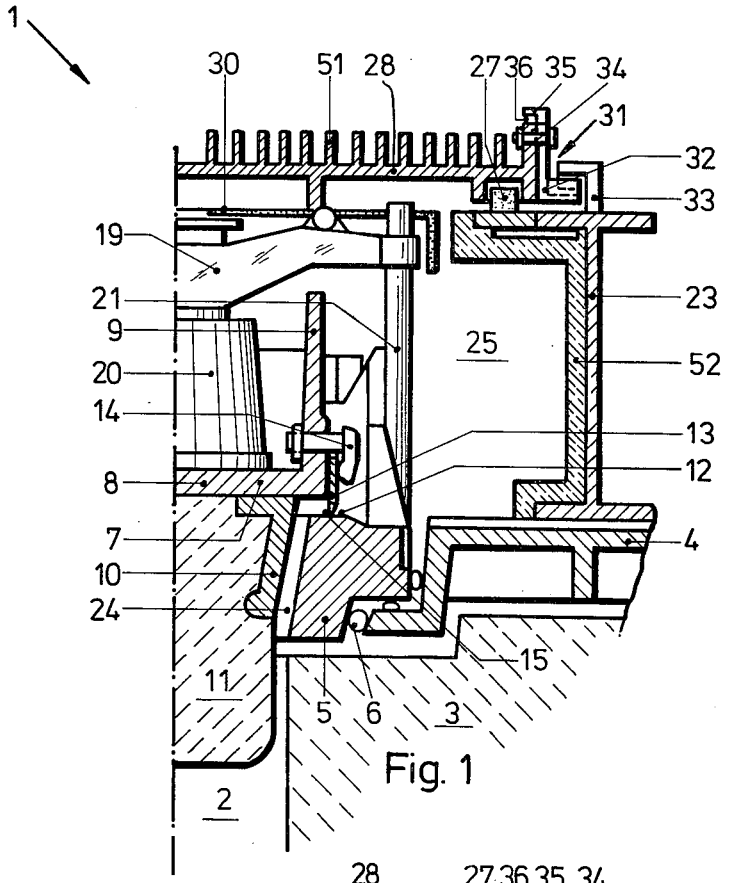
FIG. 1 is a horizontal cross-section through a first embodiment and illustrating one-half of a closure for the open end of a coking oven chamber.

In all embodiments illustrated, the closure for the charging opening of a coking chamber is generally designated with the reference numeral 1 and this closure 1 is in all embodiments located at the end of a horizontally extending coking chamber 2.

The walls of the coking oven are covered at the outer surface thereof by plates 4 of cast iron and an endless frame 5 surrounding the opening of the coking chamber 2 is fixedly connected, by means not shown in the drawing, to the aforementioned plates 4, with sealing means 6 sandwiched between the outer surface of the frame 5 and the corresponding opening in the cast iron plates 4. The frame 5 is likewise formed from cast iron and has a uniform cross-section throughout its circumference.

The coking chamber closure 1, of all embodiments shown, comprises a door body 7 formed from cast iron. The door body 7 is box-shaped, having a bottom wall 8 which covers the opening of the coking chamber 2 and side walls 9, forming reinforcing ribs, and projecting substantially normal in outward direction from the bottom wall 8. A plug 11 of refractory material projects, from the side of the bottom wall 8 facing the coking chamber, into the opening of the latter and is held onto the bottom wall by clamps 10, fixed to the bottom wall 8 in any convenient manner.

The frame 5 is provided at its end face directed away from the coking chamber 2 with an endless, smooth sealing surface 12. An endless sealing bar 13 of metal surrounds the door body 7 and is held on the latter by clamps 14 to be adjustable toward the sealing surface 12. The sealing bar 13 is provided, at its end facing the sealing surface 12, with an endless sharp edge 15 which is pressed against the sealing surface 12 of the frame 5. The sealing bar 13 can, for instance by means of hammer blows, be moved towards the frame 5. When the sharp edge 15 of the sealing bar 13 engages the sealing surface 12 of the frame 5, it constitutes a preseal of the opening of the coking chamber in that it seals the region 24 between the frame 5 and the door body 7.

The upper portion of the door body is in all embodiments provided with an aperture 16, serving for insertion of a tool for levelling the coal charged into the coking chamber 2. The aperture 16 is closed by additional closure means 17. Similar to the door body, the additional closure means 17 is also provided with a sealing bar 18 made from metal. The sealing bar 18 for the aperture 16 is likewise provided with a sharp edge directed towards the door body 7 and there held on the additional closure means 7 by non-illustrated clamps, in a manner similar as described above for the sealing bar 13. The sharp edge of the sealing bar 18 is pressed in engagement with a corresponding end face of the door body 7 about the aperture 16, in the manner as described above.

Means for pressing the door body 7 against the frame 5 and for locking the door body in a position tightly engaging the frame are coordinated with each door body 7. These pressing and locking means comprise at least one, but preferably two, locking bars 19 which are turnable about an axis normal to the bottom wall 8 of the door body and movable toward and away from the bottom wall, and a pressure producer 20 as well as locking bar holder 21 are coordinated with each of the locking bars 19. Each locking bar holder 21 is fixedly connected to the frame 5 and is provided at its free end with a hook 22. After the door body 7 is placed in the frame 5, the locking bars 19 are turned so that the free ends thereof engage behind the hooks 22 of the locking bar holder 21 so that the door body 7 is pressed under the force produced by the pressure producers 20 in the direction toward the frame 5 until the sharp edge 15 of the sealing bar 13 tightly engages the sealing face 12 of the frame 5. Each of the pressure producers 20 comprises, as indicated for instance in FIG. 3, a housing 20*a* fixed to the bottom wall 8 of the door body 7, a coil compression spring 20*b* sandwiched between the bottom wall 7 and a bolt 19*a* extending through the top wall of the housing 20*a* and carrying a locking bar 19. The bolt 19*a* is turnable about its axis and together with the locking bar 19 shiftable in axial direction. The preseal of the coking chamber 2 produced by the sealing bar 13 can be further increased by moving the sealing bar 13 relative to the door body 7 toward the sealing surface 12, in the manner as described before.

The coking chamber 2 is, in all embodiments disclosed, reinforced at its outer wall by bracing members 23 fixed to and abutting against the plates 4 and provided at each of the longitudinal sides of the frame 5. The bracing members 23 are formed by I-beams, projecting outwardly from the plates 4 and connected thereto in any convenient manner. A lock chamber 25 is provided in all of the embodiments outwardly of the region 24 between the door frame 5 and the door body 7 and the lock chamber 25 is gas-tightly sealed toward the surrounding atmosphere.

The interior of the lock chamber 25 is filled with air and eventually also with emissions from the coking chamber 2, such as dust, gas and tar-containing vapors. The lock chamber 25 constitutes a complete seal of the coking chamber 2 toward the atmosphere and will prevent passage of the aforementioned emissions to the surrounding atmosphere.

In the embodiments shown in FIGS. 1–10, the lock chamber 25 is formed by portions of the bracing members 23 extending along the longer sides of the rectangular door frame 5, a pair of transverse walls 26, 26*a* extending between the bracing members adjacent to the shorter sides of the frame 5 and gas-tightly connected to the bracing members, and a front plate 28 abutting against the outer edges of the bracing members 23 and the transverse walls 26, 26*a*, with an elastically compressible seal strip 27 sandwiched between the front plate 28 and the aforementioned outer edges of the bracing members and transverse walls.

In the three embodiments illustrated in FIGS. 1–7, the front plate or outer door 28 is operable independent from the door body 7, and covers the whole region between the bracing members 23 and the transverse walls 26 and 26a. The pressure and locking means coordinated with the door body 7, that is the locking bars 19 including their pressure producers 20 and the locking bar holders 21, as well as the aperture 16 provided in the door body, including the additional closure means 17 for this aperture, are arranged within the lock chamber 25. The arrangement of the aperture 16 is clearly illustrated in FIGS. 3 and 6. The locking bar holders 21 are in these embodiments provided on the longer sides of the frame 5, laterally of the sealing surfaces 12 thereof.

In the three first embodiments, illustrated in FIGS. 1–6, a radiation shield 30 is further provided between the door body 7 and the outer door 28, extending substantially over the whole area of the outer door 28, inwardly spaced therefrom and substantially parallel thereto.

In the first and second embodiment, as illustrated in FIGS. 1–4, the outer door 28 is, by means of a wedge arrangement 31, gas-tightly pressed against the outer edges of the transverse plates 26, 26a and the bracing members 23. The wedge arrangement 31 comprises inner wedges 32 connected to the longitudinal sides of the outer door 28 and outer wedges 33 connected to the bracing members 23. The inner wedges 32 abut against the longitudinal sides of the outer door 28 and are movably connected thereto by bolts 34 and secured against excessive tilting movement by arresting plates 35, projecting laterally over the outer door and separated therefrom by an air gap 36.

In the first embodiment illustrated in FIG. 1, the outer wedges 33 are fixedly connected to the bracing members 23. In this arrangement the outer door 28 is moved during its application and removal in a direction substantially normal to its plane.

Figure 2:
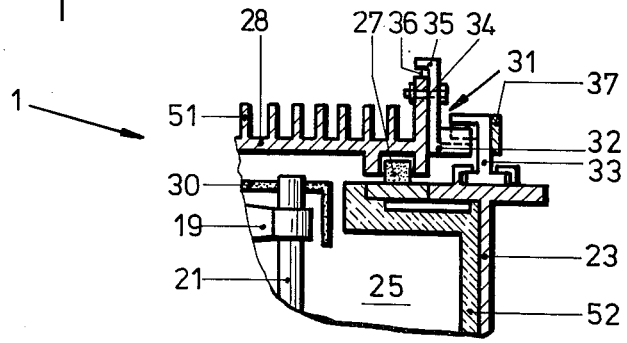
FIG. 2 is a partial cross-section through a closure according to a second embodiment.
Figure 3:
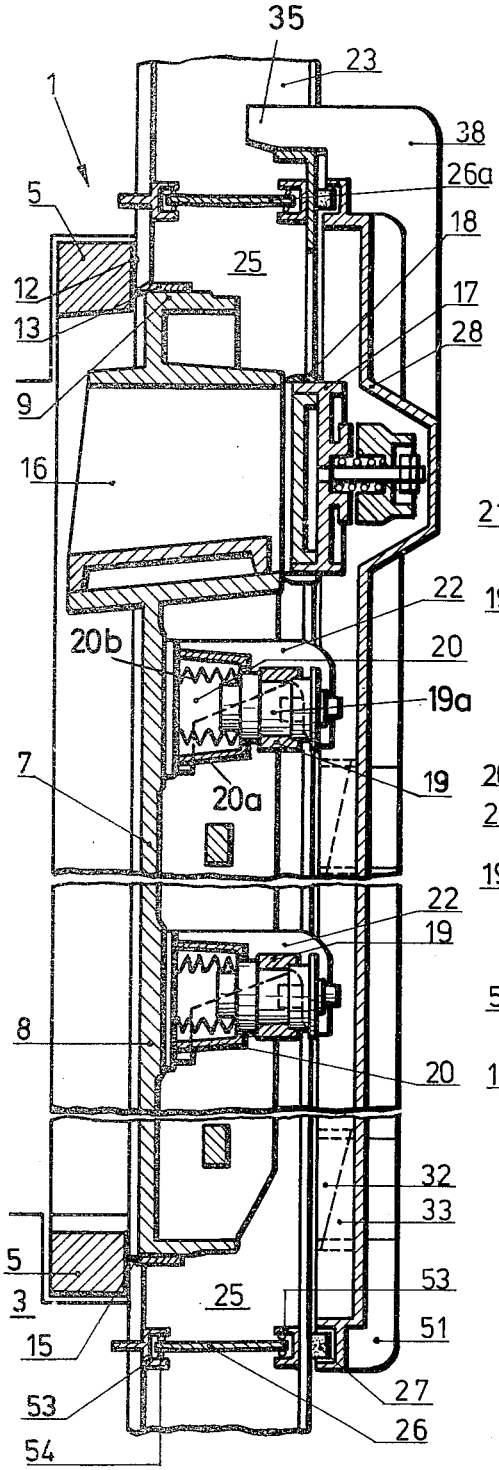
FIG. 3 is a longitudinal cross-section of the embodiment shown in FIG. 2.
Figure 4:
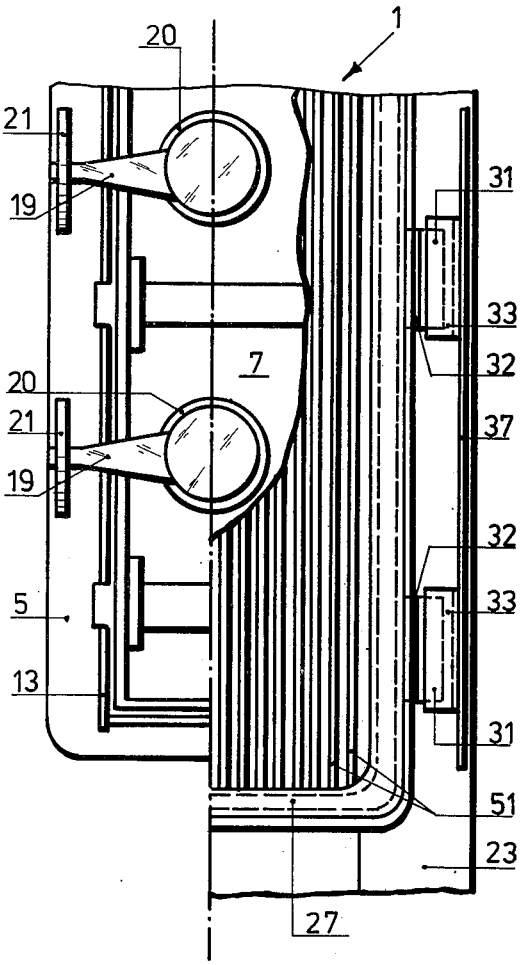
FIG. 4 is a partial front view of the embodiment shown in FIG. 2 and partly shown without an outer door.

In the second embodiment illustrated in FIGS. 2–4, the outer wedges 33 are movable in the longitudinal direction of the bracing members 23. In this construction the the outer wedges 33, arranged at one side of the outer door 28, are connected by a linkage 37 with each other. In this embodiment the outer door 29 is provided, as shown in FIG. 3, in its upper region with a suspension loop 38 having an inclined introduction nose 35. In this embodiment the outer door 28 may be moved in longitudinal direction during its application and removal.

Figure 5:
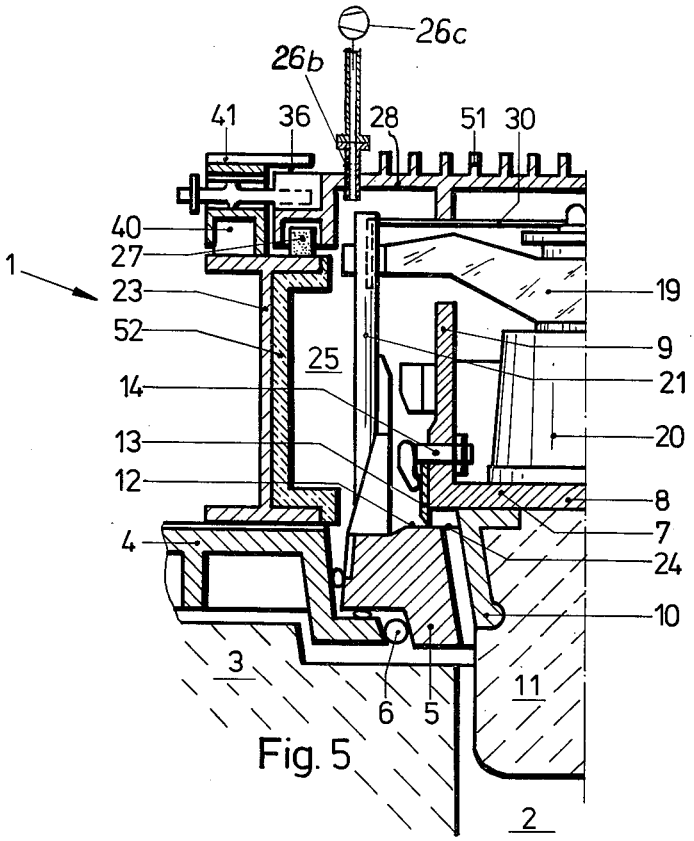
FIG. 5 is a horizontal cross-section of a third embodiment and illustrating half of a closure.
Figure 6:
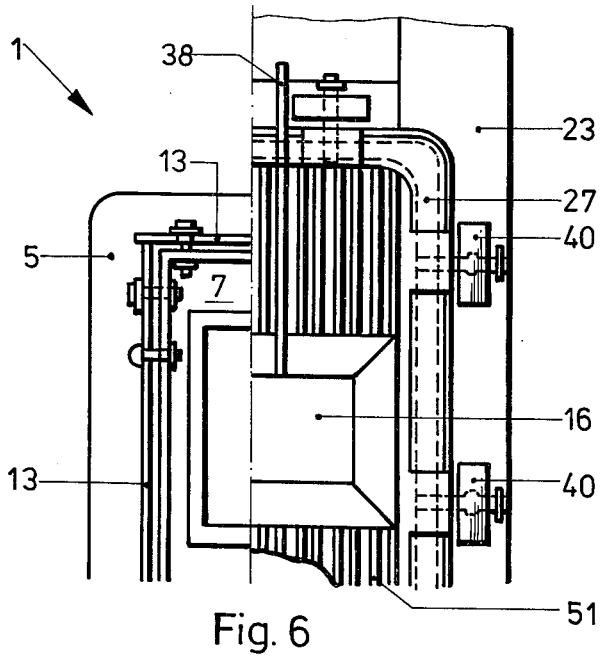
FIG. 6 is a partial front view of the embodiment shown in FIG. 5 and partially shown without a front door.

Whereas the lock chamber 25 in the first and second embodiment, as well as in the fourth to the eighth embodiment, is constructed as an overpressure chamber, in the third embodiment, illustrated in FIGS. 5 and 6, the lock chamber 25 is constructed as an underpressure chamber. In this third embodiment suction means are coordinated with the lock chamber 25 to reduce the pressure therein. The suction means may comprise a conduit 26b communicating with the interior of the lock chamber 25 and a suction pump 26c connected to the outer end of the conduit. Due to the underpressure within the lock chamber 25, the outer door 28 in this embodiment is constructed considerably lighter than in the other embodiments. The outer door 28 can in this embodiment be held by magnetic force against the bracing members 23 and the transverse plates 26, 26a. For this purpose magnets 40, cardanic mounted on the longitudinal sides of the outer door 28, are provided. During removal of the outer door 28, the magnets 40 are prevented by arresting plates 41 to carry out excessive tilting or turning movements. Between the arresting plates 41 and the outer door 28 an air gap 36 is provided, in order not to impair the cardanic suspension of the magnets 40. As shown in FIG. 6, the outer door 28 is also in this embodiment provided with a suspension loop 38.

In the three first embodiments above described, the closure of the opening of the coking chamber is carried out in two steps. In the first step the door body 7 is pressed against the frame 5 by means of the locking bars 19, the pressure producing means 20 and the locking bar holders 21. In the second step the outer door 28 is applied and held by the magnets or the wedges described above.

In the fourth to the eighth embodiment, illustrated in FIGS. 7–13, it is possible to seal the coking chamber in a single operation towards the atmosphere.

In the fourth and fifth embodiment, illustrated in FIGS. 7–10, the lock chamber 25 is likewise constituted by portions of the bracing members 23, the transverse walls 26 and 26a, gas-tightly connected to the bracing members, and the front plate 28 arranged at the outer ends of the bracing members and transverse plates, with an elastically compressible sealing strip 27 sandwiched between the front plate 28 and the bracing members 23 and the plates 26, 26a. In these modifications the side walls 9 of the door body 7 are provided at the outer ends thereof with an endless flange 42 extending substantially normal to the side walls 9 outwardly therefrom. The flange 42 abuts against the front plate 28, with sealing means sandwiched therebetween, and the front plate 28 is connected by screws or the like, not shown in the drawing, to the flange 42. In the embodiment shown in FIG. 7, a sealing strip 43 of circular cross-section and an additional sealing strip 44 of square cross-section is sandwiched between the front plate 28 and the flange 42, whereas in the embodiment shown in FIG. 8, a flat sealing strip 45 is provided between these two members.

The two pressure producers 20 coordinated with the locking bars 19 are surrounded, on the one hand, by a portion of the side walls 9 of the door body and, on the other hand, by cross ribs 46 located between the side walls 9. The cross ribs 46 projecting outwardly from the bottom wall 7 of the door body 8 are provided at their outer ends with laterally extending flanges 47 located in one plane with the flanges 42 of the side walls 9.

The front plate 28 covers not only the region between the bracing members 23 and the transverse walls 26, 26a, as well as the area between the side walls 9 of the door body 7, but also those parts of the bottom wall 8 of the door body to which the pressure producers 20 are connected and which are bound by the cross ribs 46 as well as by parts of the side walls 9 opposite the pressure producers 20. Thereby, the flanges 47 of the cross ribs 46 abut likewise against the front plate 28, with sealing means sandwiched therebetween.

In these fourth and fifth embodiments, the holders 21 for the locking bars 19 are again connected to the longitudinal portions of the frame 5 adjacent the sealing faces 12 thereof. The side walls 9 are provided with cutouts 48 through which the outer ends of the locking bars 19 extend in the turned position in engagement with the locking bar holders 21. In the described construction of the front plate 28, the side walls 9 of the door body 7 and the cross ribs 46, the locking bars 19 including their pressure producers 20 are gas-tightly enclosed toward the exterior since they are located within the lock chamber 25.

Figure 10:
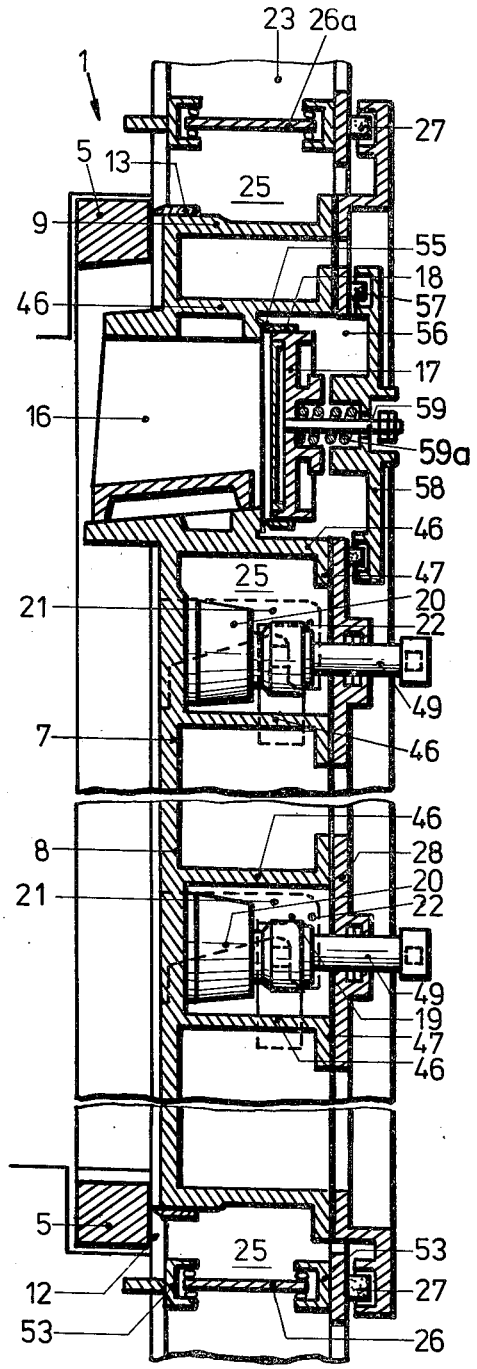
FIG. 10 is a longitudinal cross-section of the embodiment shown in FIG. 8.

Portions of the bottom wall 8 are, as clearly shown in FIG. 10, not covered by the front plate 28 so that the heat energy transmitted to the bottom wall 8 from the interior of the coking chamber can be conducted to the surrounding atmosphere through the uncovered portions of the bottom wall 8.

The locking bars 19 and their pressure producers 20 are respectively provided with operating shafts 49 which extend in a sealed manner through openings in the front plate 28. In this way the locking bars 19 and the pressure producers 20 can be operated from the outside.

Figure 7:
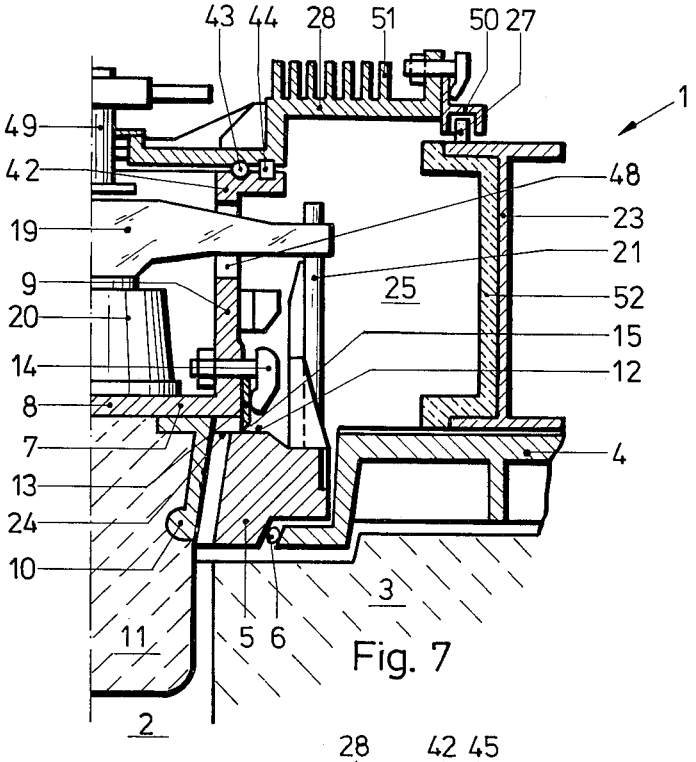
FIG. 7 is a horizontal cross-section of half of a closure according to a fourth embodiment.

In the fourth embodiment, illustrated in FIG. 7, the portion of the front plate 28 which receives the sealing strip 27 is not integrally formed with the front plate 28, as in the other embodiments, but in this embodiment a grooved bar 50 is provided surrounding the outer periphery of the front plate 28 and frictionally held thereagainst by clamping means, similar to the clamping means 14 described in connection with FIG. 1. This grooved bar 50 may be moved, by hammer blows or the like, toward the bracing members 23 and the transverse plates 26, 26*a* and the sealing strip 27 located in the groove of the bar 50 is formed by an elastically compressible material.

In the embodiments shown in FIGS. 7–10, the door body 7 is moved together with the front plate fixedly connected thereto, toward the door frame 5. The pressure forces produced by the pressure producers 20 assure thereby that not only the door body 7 is gas-tightly pressed against the frame 5, but also that the front plate 28 is at the same time gas-tightly pressed against the outer edges of the bracing members 23 and the transverse plates 26, 26*a*.

Figure 9:
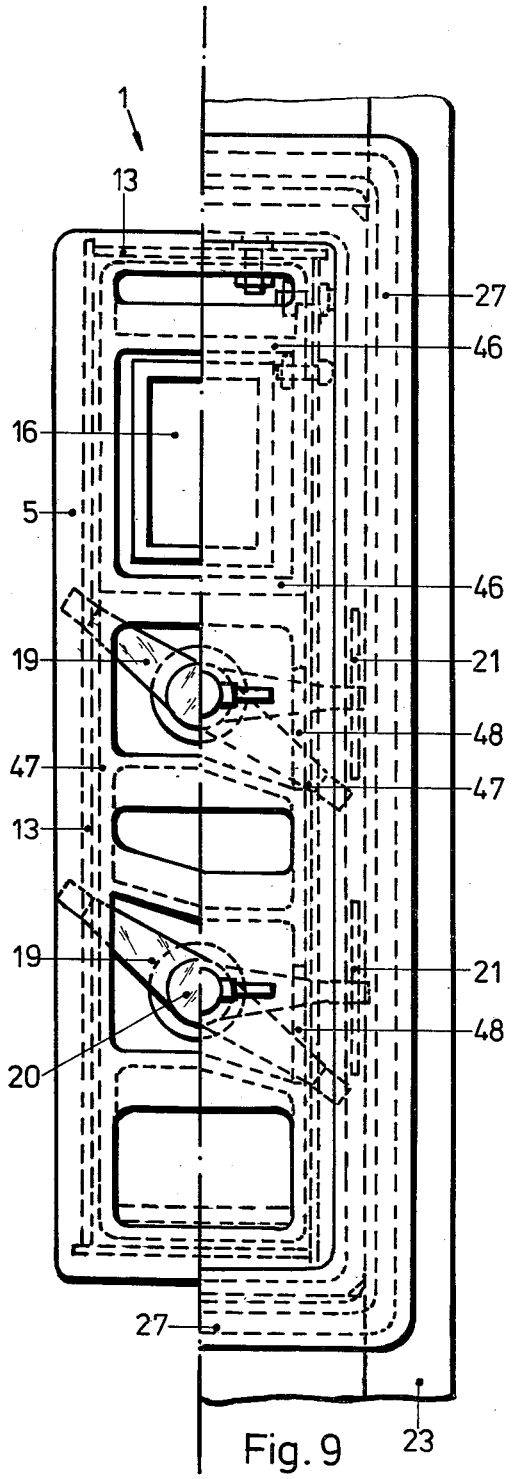
FIG. 9 is a front view of the embodiment shown in FIG. 8, partially shown without the front plate.

FIGS. 9 and 10 illustrate the construction of the aperture 16 in the door body 8 in the fifth embodiment. As shown in FIG. 10, the region 55 between the aperture 16 and the additional closure 17 is, in the closed position, likewise gas-tightly closed by an additional lock chamber 56. The additional lock chamber 56 is filled with air and collects also any emissions seeping eventually from the coking chamber 2 in the region 55 between the aperture 16 and the additional closure means 17. The additional lock chamber 56 is closed, towards the surrounding atmosphere, by an additional front plate 58 abutting against the front plate 28, with a sealing strip 57 sandwiched therebetween. The additional closure means 17 and the additional front plate 58 are pressable and fixable together against the aperture 16, whereby the additional closure means 17 and the additional front plate 58 are connected together by a connecting screw 59 extending in a sealed manner through an opening in the plate 58. During closing of the aperture 16, the additional front plate 58 is pressed by a non-illustrated lever arrangement through the intermediary of a seal strip 57 against the front plate 28, while a pretensioned coil compression spring 59*a* presses the additional closure means 17 against the face about the aperture 16.

In the embodiments illustrated in FIGS. 1–7, the front plate 28 is provided at the outer side therof with cooling ribs 51. In all so far described embodiments, the bracing members 23 are provided, on the sides thereof facing the interior of the lock chamber 25, with a heat-insulating layer 52. Furthermore, the transverse plates 26, 26*a* in the embodiments illustrated in FIGS. 1–10 are floatingly mounted in grooved bars 53, respectively fixed opposite to each other in a gas-tight manner to the bracing members 23 and the plates 4, with sealing means 54 sandwiched between the grooved bars and the end portions of the transverse walls.

In the embodiments illustrated in FIGS. 11, 12, 13, 15 and 16, the lock chambers 25 are formed as an endless lock channel surrounding the door body 7, in which the side walls 9 of the door body form part of the walls of the lock chamber 25. In these embodiments the side walls 9 of the door body are provided at the outer ends thereof with a laterally outward extending flange 60. Furthermore, the locking bars 19 and the pressure producers 20 coordinated therewith are arranged in these embodiments outside of the lock chamber 25 and so is the bottom wall 8 of the door body 7.

Figure 11:
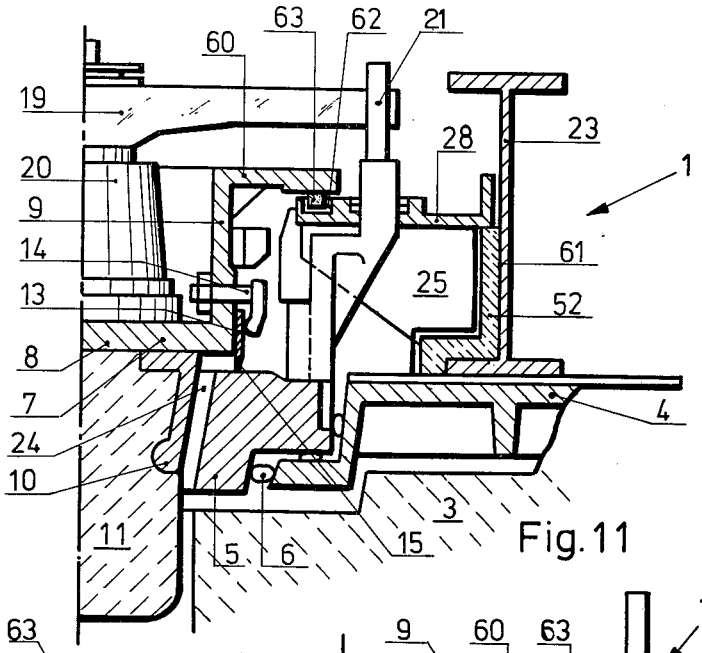
FIG. 11 is a horizontal cross-section through half of a sixth embodiment of a closure.
Figure 15:
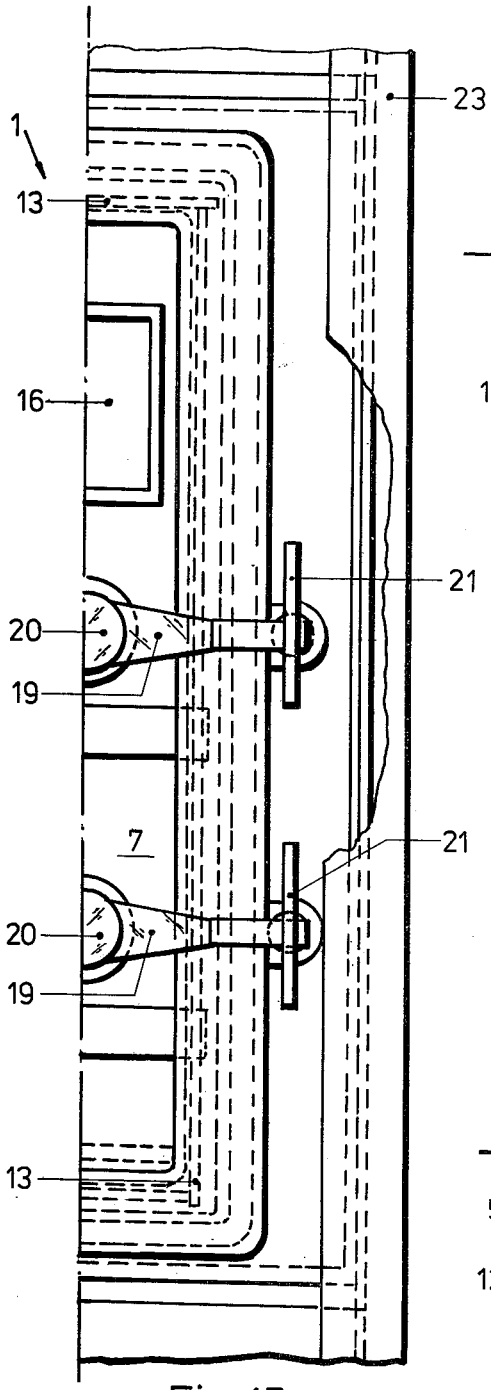
FIG. 15 is a front view of half of the embodiment shown in FIG. 11, with some of the parts broken away.
Figure 16:
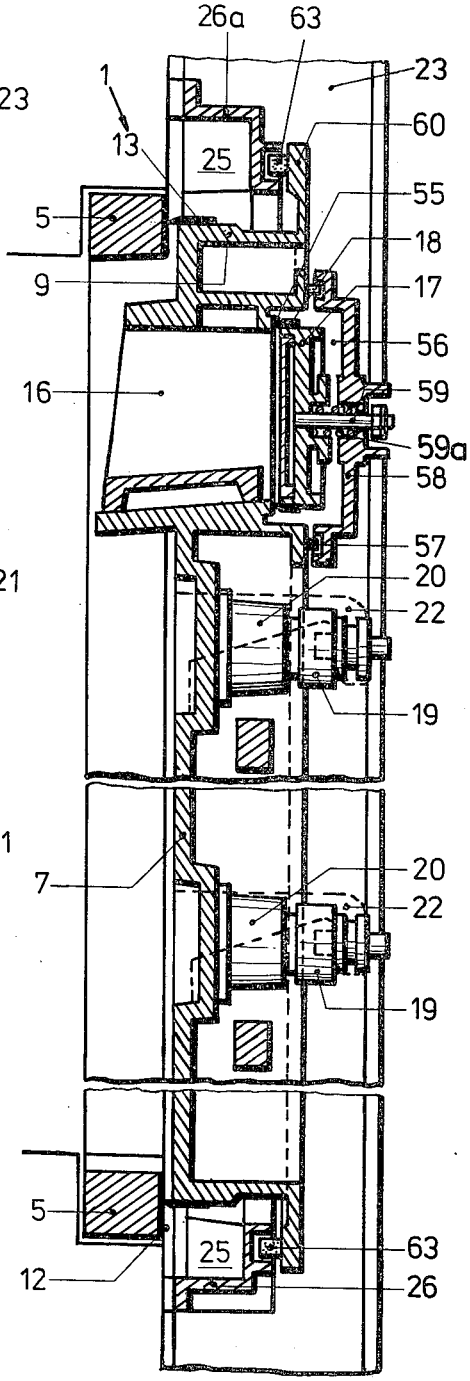
FIG. 16 is a longitudinal cross-section through the embodiment shown in FIG. 11.

In the embodiment shown in FIGS. 11, 15 and 16, the lock chamber 25 is bounded by the side walls 9 of the door body 7, the bracing members 23 and the transverse walls 26, 26*a*, gas-tightly extending between the bracing members 23, and a front plate 28 covering the area between the bracing members 23 and the transverse walls 26, 26*a*, on the one hand, and the side walls 9, on the other hand. The front plate is connected to the webs 61 of the bracing members 23 and is arranged parallel to the plates 4. The front plate 28 is provided at the outer face at its inner circumference with an endless groove 62 receiving an elastically compressible sealing strip 63, which is sandwiched between the front plate 28 and the flange 60 extending outwardly from the side walls 9 of the door body 7.

In the sixth embodiment, illustrated in FIGS. 11, 15 and 16, the locking bar holders 21 are fixedly connected to the frame 5 and extend gas-tightly sealed through openings in the front plate 28. In this embodiment the bracing members 23 are covered at the faces thereof directed to the interior of the lock chamber 25 with a heat-insulating layer 52. Furthermore, the transverse walls 26, 26*a* extending between the bracing members 23 are in this case not floatingly mounted, but fixedly connected to the bracing members 23 and the plates 4.

Figure 8:
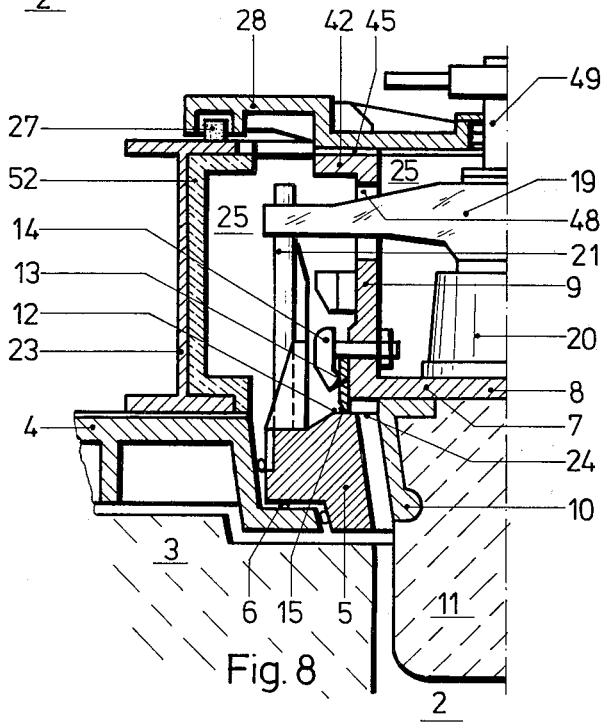
FIG. 8 is a horizontal cross-section of half of a closure according to a fifth embodiment.

The arrangement of the aperture 16 in the door body 7 of the sixth embodiment is best shown in FIGS. 15 and 16. In this construction there is likewise provided, outside the region 55 between the aperture 16 and the additional closure means 17, a gas-tightly closed, additional lock chamber 56, containing air, as well as any emissions seeping from the coking chamber 2. The additional lock chamber 56 is constructed as illustrated in FIGS. 8–10 and as described above in connection with the fifth embodiment.

Figure 12:
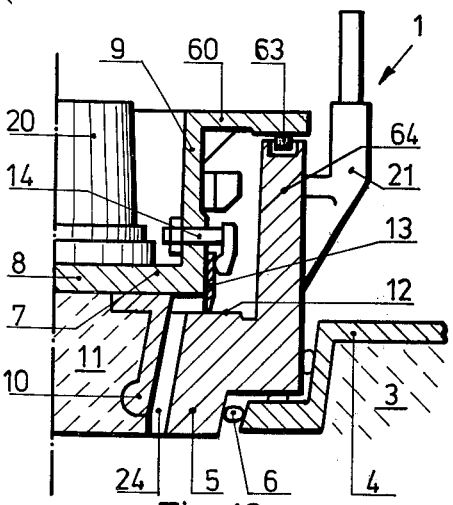
FIG. 12 is a horizontal cross-section of half of a seventh embodiment.

In the seventh embodiment, illustrated in FIG. 12, the frame 5 is likewise box shaped and the lock chamber 25 is bounded toward the atmosphere by the side walls 64 of the frame 5, as well as by side walls 9 of the door body 7. The side walls 9 of the door body 7 are again provided at the outer ends thereof with an outwardly extending flange 60 which abuts against the outer edges of the side walls 64 of the frame 5 with a sealing strip 63 sandwiched therebetween. The locking bar holders 21 are in this embodiment arranged completely outside of the lock chamber 25 and are connected to the outer surface of the side walls 64 of the frame 5.

Figure 13:
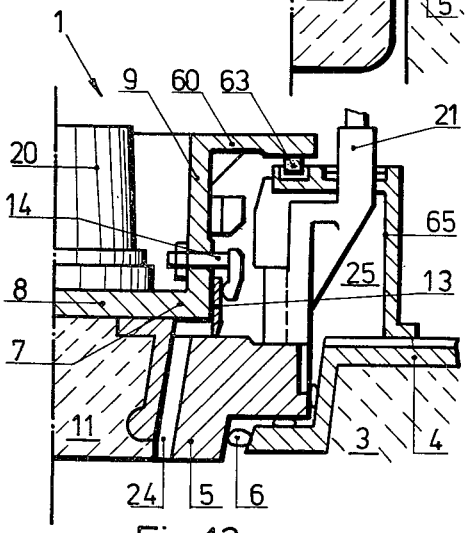
FIG. 13 is a horizontal cross-section through half of an eighth embodiment.

In the eighth embodiment, illustrated in FIG. 13, an endless sealing frame 65 is gas-tightly connected to the plates 4 and the lock chamber 25 is closed toward the atmosphere by the sealing frame 65, as well as the side walls 9 of the door body 7 with the laterally extending flange 60, which abuts against a correspondingly inwardly extending flange of the sealing frame 65, with an elastically compressible sealing strip 63 sandwiched between the two flanges. The locking bar holder 21 is fixedly connected to the frame 5 and extends gas-tightly sealed through an opening in the sealing frame 65.

In the embodiment illustrated in FIGS. 11–13, 15 and 16 the complete seal of the coking chamber 2 is carried out in a single operating step, in that the door body 7 is pressed against the frame 5 by means of the locking bars 19 and the pressure producers 20 and locking bar holders 21 coordinated therewith. This operation will at the same time provide an outwardly gas-tightly closed channel-shaped lock chamber 25.

In all embodiments, with the exception of the third embodiment illustrated in FIGS. 5 and 6, there is provided an overpressure valve not shown in the drawings, and communicating with the interior of the lock chamber 25. If the gas pressure within the lock chamber 25 surpasses a predetermined maximum value, for instance a value in the region of 50 to 100 millimeters water column, the overpressure valve will open to discharge gas from the lock chamber 25.

Figure 14:
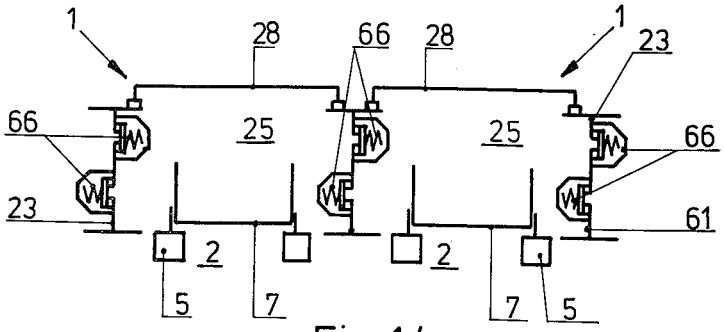
FIG. 14 is a schematic horizontal cross-section through two adjacent closures.

FIG. 14 schematically illustrates an arrangement in which two adjacent lock chambers 25 are connected to each other by overpressure valves 66 operating in opposite direction. The overpressure valves 66 are arranged in the web 64 of a bracing member separating the two adjacent lock chambers 25 from each other. The overpressure valves 66 in this arrangement permit a pressure equalization between the two adjacent lock chambers 25.

It will be understood that each of the elements described above, or two or more together, may also find a useful application in other types of closures for coking chambers of coking ovens differing from the types described above.

While the invention has been illustrated and described as embodied in a closure for a coking chamber of a coking oven provided outside with a gas-tightly closed lock chamber, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A door assembly for a coking chamber having a door opening situated in a wall of the chamber and surrounded by an annular frame, said assembly comprising:

a door body dimensioned to cover said opening;

an annular metallic sealing strip on said body engageable with said frame all around said opening;

closing means for urging said body toward said chamber and said strip into snug engagement with said frame, whereby gas is substantially prevented from escaping from said chamber between said frame and said strip;

an outer door; and means including an elastically compressible seal and an annular wall between said outer door and said wall and surrounding said door body for forming with said outer door, said door body, said frame, and said wall a substantially closed and gastight lock chamber for retaining any gas which has escaped past said metallic sealing strip from said chamber.

2. In a coking oven having an end wall and a coking chamber extending rearwardly of said end wall, said end wall being provided with a door opening, a combination comprising an endless metallic frame surrounding said opening; a door body having a bottom wall extending over said opening and side wall means projecting substantially normal to said bottom wall from the outer periphery of the latter in a direction away from said end wall; an endless metallic sealing strip having a knife edge for engaging said frame; means connecting said sealing strip to said side wall means; means cooperating with said door body for pressing the latter and said sealing strip connected thereto towards said frame to thereby substantially prevent gas in said coking chamber from escaping past said sealing strip; and means forming a gas tight lock chamber for retaining any gas which has escaped past said sealing strip to prevent such gas from penetrating into the surrounding atmosphere, said gas tight lock chamber forming means including metallic endless wall means sealingly connected at one end to said end wall outwardly spaced from said sealing strip and projecting outwardly from said end wall; and outer wall means including a resiliently compressible seal means, said outer wall means being adapted to be sealingly connected to at least one of said side wall means and said metallic endless wall means for closing said lock chamber.

3. A combination as defined in claim 2, wherein said means connecting said endless metallic sealing strip to said side wall means of said door body is adjustable toward said frame.

4. A combination as defined in claim 2, wherein said means for pressing said door body and said sealing strip connected thereto toward said frame comprise a locking bar turnable between an active and an inactive position and operatively connected to said door body, and a locking bar holder connected at one end to said frame and provided at the other end thereof with a hook engaged by said locking bar in the active position of the latter.

5. A combination as defined in claim 2, wherein said outer wall means closing said lock chamber comprises a front plate releasably connected to said endless wall means, with said compressible seal means being located between said endless wall means and said front plate.

6. A combination as defined in claim 5, wherein said front plate is provided at its outer side with a plurality of cooling ribs.

7. A combination as defined in claim 5, wherein said means for pressing said door body and said sealing strip connected thereto against said frame are located in their entirety within said lock chamber.

8. A combination as defined in claim 7, and including a radiation shield between said door body and said front plate extending substantially parallel to and over a major portion of the latter.

9. A combination as defined in claim 2, wherein said end wall comprises an outer metal plate about said metallic frame, said metallic endless wall means being sealingly connected to said outer metal plate.

10. A combination as defined in claim 9, wherein said endless wall means comprise two vertical bracing members projecting outwardly from said outer metal plate, and transverse walls extending therebetween.

11. A combination as defined in claim 10, wherein said bracing members are covered at inner faces thereof with a layer of heat insulating material.

12. A combination as defined in claim 9, wherein said metallic endless wall means comprise an endless sealing frame.

13. A combination as defined in claim 12, wherein said sealing frame has an inwardly extending annular flange and said side wall means of said door body has an outwardly extending annular flange overlapping said annular flange of said sealing frame with said compressible seal means being located between said flanges, said flanges constituting said outer wall means closing said lock chamber.

14. A combination as defined in claim 13, wherein said means for pressing said door body and said sealing strip connected thereto toward said endless metallic frame comprise a locking bar turnable between an active and an inactive position and operatively connected to said door body and a locking bar holder connected at one end to said endless metallic frame and provided at the other end thereof with a hook engaged by said locking bar in the active position of the latter, said locking bar holder extending in a sealed manner through said inwardly extending flange of said sealing frame with said hook on the outer end of said locking bar holder located outside of said lock chamber.

* * * * *